US006901890B2

(12) United States Patent
Sato

(10) Patent No.: US 6,901,890 B2
(45) Date of Patent: Jun. 7, 2005

(54) VEHICLE STRUCTURE

(75) Inventor: Eiichi Sato, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/398,027

(22) PCT Filed: Dec. 17, 2001

(86) PCT No.: PCT/JP01/11061

§ 371 (c)(1),
(2), (4) Date: Apr. 1, 2003

(87) PCT Pub. No.: WO02/053893

PCT Pub. Date: Jul. 11, 2002

(65) Prior Publication Data

US 2004/0020448 A1 Feb. 5, 2004

(30) Foreign Application Priority Data

Dec. 27, 2000 (JP) ..... 2000-397540

(51) Int. Cl.[7] ..... F01P 1/06

(52) U.S. Cl. ..... 123/41.31; 123/198 E; 180/68.1

(58) Field of Search ..... 123/41.31, 198 E, 123/184.21; 180/68.1

(56) References Cited

U.S. PATENT DOCUMENTS 4,632,662 A 12/1986 Handa
5,207,186 A 5/1993 Okita
5,269,264 A 12/1993 Weinhold
5,875,746 A 3/1999 Izuo
6,045,421 A 4/2000 Hiraoka et al.
6,155,895 A 12/2000 Sato et al.
6,186,106 B1 * 2/2001 Glovatsky et al. ..... 123/143 C
6,357,414 B1 * 3/2002 Kalinowski et al. .... 123/198 E
2001/0045206 A1 11/2001 Smith et al.

FOREIGN PATENT DOCUMENTS

DE 44 39 792 A1 5/1995
DE 43 44 027 A1 6/1995
JP 06108938 A * 4/1994 ..... F02M/35/10
JP 08-291711 A 11/1996
JP 11-294289 A 10/1999

* cited by examiner

*Primary Examiner*—Noah P. Kamen
(74) *Attorney, Agent, or Firm*—Shinjyu Global IP Counselors, LLP

(57) ABSTRACT

An electrical unit mounting structure is provided to dispose an electrical unit that emits a large amount of heat such that cooling performance is ensured. In one embodiment, an injector drive unit (IDU) 7 is mounted to an upper wall of a collector 6, which is disposed on an uppermost part of the engine 1 between the banks. The injector drive unit 7 is equipped with the cooling fins 7*b* on the lower surface thereof and is cooled with good efficiency by cooling air flowing in the longitudinal direction between the engine cover 10 and the collector 6. The electrical unit mounting structure can be used in a variety of engine arrangements such as a longitudinally arranged V-type engine, a transversely arranged V-type engine, a longitudinally arranged inline engine, or a transversely arranged inline engine.

21 Claims, 6 Drawing Sheets

VEHICLE STRUCTURE

This application is the National Stage under 35 U.S.C. § 371 of International Application No. PCT/JP01/11061, which was filed on Dec. 17, 2001.

BACKGROUND OF THE INVENTION

1. Technical Field

The present invention generally relates to a mounting structure for an electrical unit of a vehicle. More specifically, the present invention relates to a vehicle structure having a mounting structure that secures an electrical unit that emits a large amount of heat in an area that is well cooled.

2. Description of Related Art

In recent years, in order to improve exhaust purification performance and fuel economy, it is becoming common for gasoline engines and other spark ignition engines to inject the fuel into the combustion chamber during the compression stroke. A layer-like stratified air-fuel mixture is formed that comprises air-fuel mixtures of combustible mixture ratios that can be ignited around the spark plug so as to conduct combustion (stratified combustion) at an extremely lean air-fuel ratio (an air-fuel ratio in the vicinity of the lean limit). Japanese Laid-Open Patent Publication Nos. 62-191622 and 2-169834 disclose engines that utilize direct injection of the fuel into the combustion chamber during the compression stroke.

In such direct injection engines, electromagnetic drive fuel injection valves are often used to inject fuel into the combustion chamber during the compression stroke. The electromagnetic drive fuel injection valves consume a large amount of electric power because the fuel is injected at a high pressure during the compression stroke. Consequently, the electronic drive circuit or unit that drives the fuel injection valves supplies a large amount of power and emits a large amount of heat.

Japanese Laid-Open Patent Publication No. 11-294289 discloses mounting the drive unit of an electromagnetic drive fuel injection valve to the exhaust manifold on the upper part of an engine. Since the drive unit is mounted on the high-temperature exhaust manifold, a separate cooling device is needed for the drive unit. The cooling device has cooling fins that need to be mounted so that the cooling fins are aimed upward on the side opposite of the exhaust manifold. Therefore, an even larger space is required for mounting an engine cover over the exhaust manifold and the cooling device. Furthermore, since the cooling fin structure requires air to pass over the cooling fins, it is also necessary to install the air guide structure.

In view of the above, there exists a need for an improved mounting structure for installing an electrical unit that emits a large amount of emitted heat. This invention addresses this need in the art as well as other needs, which will become apparent to those skilled in the art from this disclosure.

SUMMARY OF THE INVENTION

The present invention was created in view of these prior issues and its object is to provide an electrical unit mounting structure that enables an electrical unit having a large amount of emitted heat to be cooled well without increasing the cost.

Basically, the present invention is directed to a vehicle structure comprising an electrical unit of a vehicle, an air induction component configured to be located inside an engine compartment of the vehicle, and a mounting structure configured and arranged to mount the electrical unit to the air induction component.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
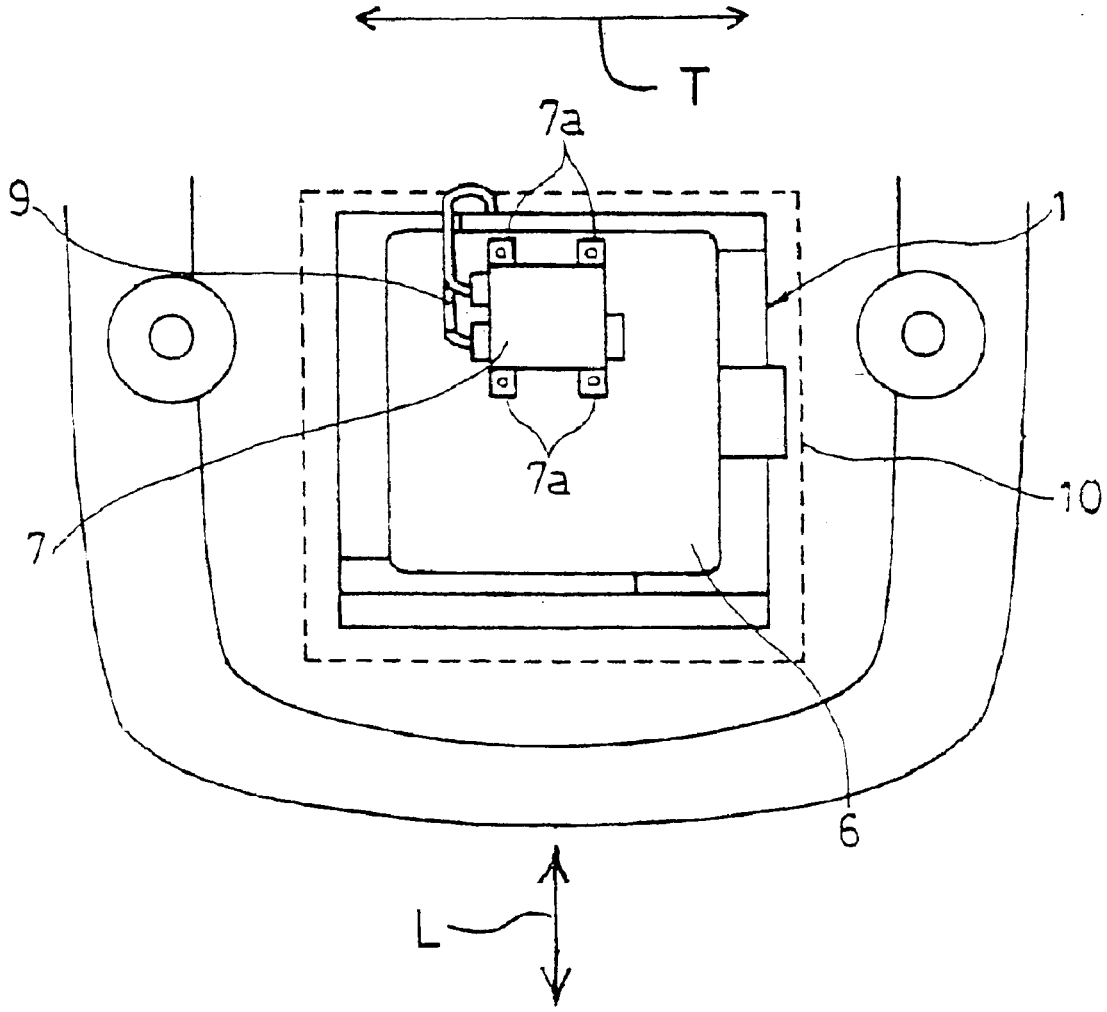
FIG. 1 is a diagrammatic top plan view of a longitudinally mounted V-type engine in which an injector drive unit (IDU) is mounted in accordance with a first embodiment of the present invention.
Figure 2:
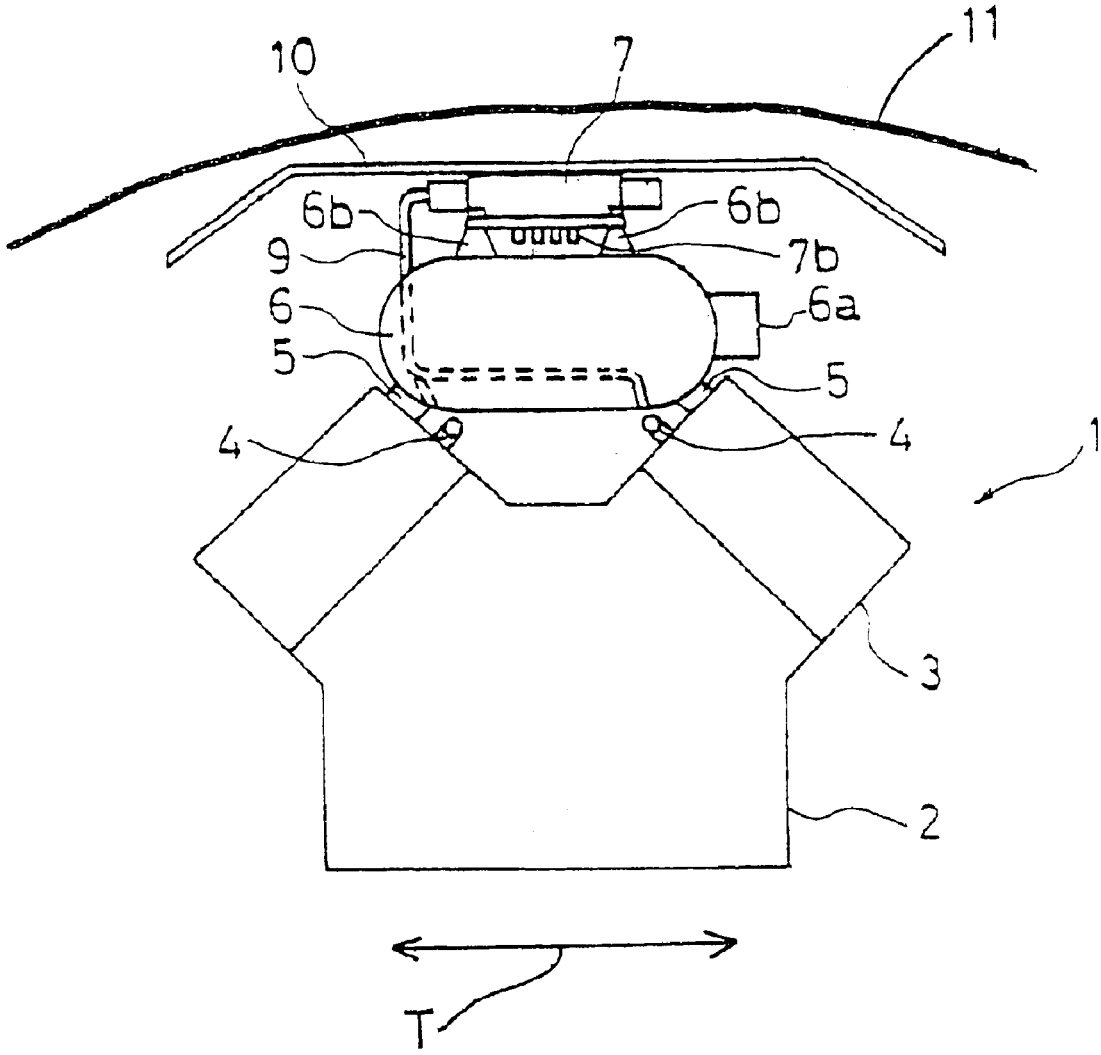
FIG. 2 is a diagrammatic front elevational view of the V-type engine with the injector drive unit mounted thereon in accordance with the first embodiment of the present invention.
Figure 3:
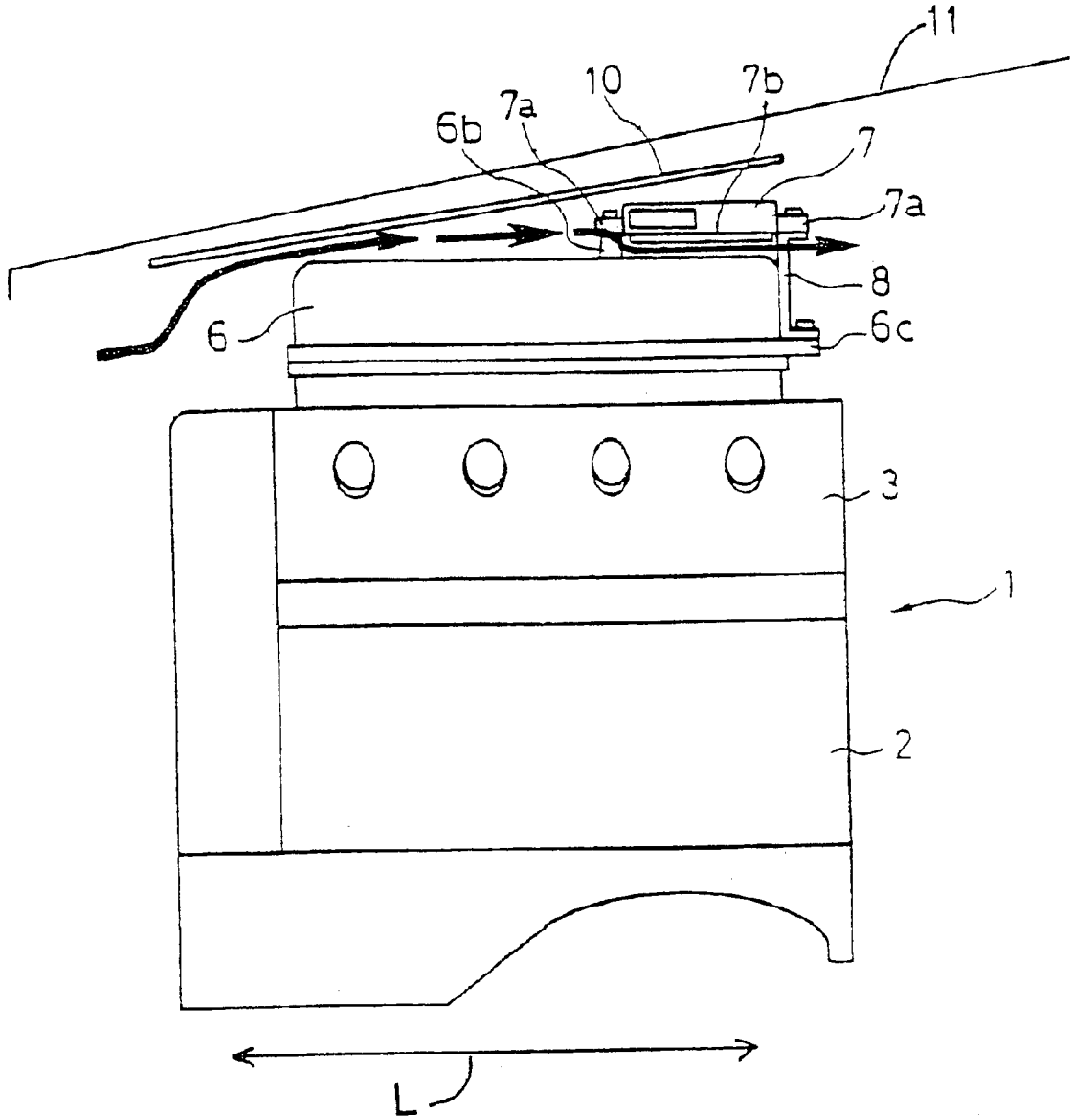
FIG. 3 is a diagrammatic left side elevational view of the V-type engine with the injector drive unit mounted thereon in accordance with the first embodiment of the present invention.

Referring initially to FIGS. 1–3, a vehicle structure is illustrated to explain a first embodiment of the present invention. Basically, the vehicle structure has an engine 1 with an air intake collector 6 (air induction component) mounted thereon and an electrical unit in the form of an injector drive unit (IDU) 7 mounted on the air intake collector 6 using a mounting structure of the first embodiment of the present invention. The mounting structure is configured and arranged to secure the injector drive unit 7 on an upwardly facing surface of the air intake collector 6 to form an air space between the injector drive unit 7 and the air intake collector 6. In particular, FIGS. 1–3 diagrammatically illustrate the mounting structure of the first embodiment of the present invention used to mount the injector drive unit 7 on a longitudinally mounted V-type engine 1. In other words, the first embodiment is an application of the present invention in which the V-type engine 1 that is disposed longitudinally (i.e., the cylinders are lined in the longitudinal direction L of the vehicle) inside an engine compartment in the front end of a vehicle. Of course, as explained below, the engine 1 can be disposed transversely (i.e., the cylinders are lined in the transverse direction T of the vehicle) inside an engine compartment in the front end of a vehicle. As used herein, the phase "longitudinally arranged" as used to describe an engine means an engine having its engine cylinders aligned in the longitudinal direction (front to rear) of the vehicle. The phase "transversely arranged" as used to describe an engine means an engine having its engine cylinders aligned in the transverse or lateral direction of the vehicle.

Also as used herein, the following directional terms "forward, rearward, above, downward, vertical, horizontal, below, longitudinal and transverse" as well as any other similar directional terms refer to those directions of a vehicle equipped with the present invention. Accordingly, these terms, as utilized to describe the present invention should be interpreted relative to a vehicle equipped with the present invention.

The mounting structure of the present invention is designed to efficiently cool the heat generated by the electrical unit (the injector drive unit 7 in the illustrated embodiment) by coupling it to a low-temperature air induction system component. This arrangement avoids the necessity of a special cooling device, which increases the manufacturing cost of the vehicle. The advantages of applying the present invention are particularly beneficial with the injector drive unit 7, since it mainly includes power transistors that emit a large amount of heat. Thus, the injector drive unit 7 requires sufficient cooling, and is resistant to engine vibrations from the air induction passage because the injector drive unit 7 often does not include a microcomputer or other minute control circuit.

Injector drive units are conventional components that are well known in the art. Since injector drive units are well known in the art, the injector drive unit 7 will not be discussed or illustrated in detail herein. Additionally, the mounting structure of the present invention can obtain similar effects when applied to other electrical units, other than the aforementioned injector drive unit 7, which have large amount of emitted heat.

The engine 1 has a plurality of cylinders that are arranged in a V-shaped pattern with a longitudinally extending crankshaft located at the apex of the cylinders. The engine 1 has a cylinder block 2 with a pair of cylinder heads 3 mounted thereon in a conventional manner. Thus, the engine 1 is a V-type engine that has its engine cylinders arranged to form a V-shaped pattern.

The cylinder heads 3 has a plurality of electromagnetic drive fuel injection valves or injectors 4 with one of the fuel injection valves or injectors 4 being installed for each cylinder of the engine 1. Fuel is injected directly into the combustion chambers of the cylinders from the fuel injection valves 4 and stratified combustion can be conducted under prescribed operating conditions in a conventional manner. The power consumption of the fuel injection valves 4, particularly fuel injection valves in a direct injection engine, is large and the amount of heat emitted from the injector drive unit 7 is particularly large. Thus, the injector drive unit 7 requires sufficient cooling.

In this embodiment, the engine 1 is a V-type engine configured to be longitudinal arranged in the engine compartment relative to a longitudinal direction of the vehicle. This arrangement allows the injector drive unit 7 to be mounted between the cylinder heads 3 and to be mounted on the rear portion of the engine 1 where there is more vertical space above the engine 1 due to the slope of the hood cover 11. Thus, the overall height requirements for the vehicle engine compartment can be minimized in this arrangement.

The combustion chambers of the cylinders have intake ports 5 that are positioned between the cylinder heads 3. These intake ports 5 are fluidly connected to the air intake collector 6 (air induction component) that is disposed on the uppermost part of the engine 1 between the cylinder heads 3. Air is pulled in from an intake opening 6*a* of the collector 6 and then fed to the cylinders through intake ports 5.

The injector drive unit 7 that drives the fuel injection valves 4 is mounted to an upper wall or surface of the collector 6. The upper wall or surface of the collector 6 typically has a large surface area so that the injector drive unit 7 can be mounted easily and securely on the outside wall of the collector 6. Specifically, the electrical unit mounting structure includes a pair of front mounting bosses 6*b* fixedly coupled between a front portion of the injector drive unit 7 and a top surface of the collector 6, and a rear mounting bracket 8 fixedly coupled between a rear portion of the injector drive unit 7 and a rear flange 6*c* located on the rearwardly facing side surface of the collector 6. More specifically, the injector drive unit 7 has two mounting flanges 7*a* that are fastened to the mounting bosses 6*b* by a pair of fasteners such as bolts or the like. The mounting bosses 6*b* are formed so as to protrude at two locations on the rear part of the upper wall of the collector 6. As seen in FIG. 3, the bracket 8 supports the rear end part of the injector drive unit 7 on top of the collector 6. Thus, the mounting bosses 6*b* and the bracket 8 support the injector drive unit 7 above the collector 6 such that the bottom wall or surface of the injector drive unit 7 is spaced vertically above the upper wall or surface of the collector 6. In other words, when the electrical unit or the injector drive unit 7 is mounted to an outside wall of the collector 6 (air induction component), the mounting bosses 6*b* that protrudes from the outside wall of the collector 6 forms an air gap between the injector drive unit 7 and the collector 6.

As seen in FIG. 3, the bracket 8 preferably has a U-shaped vertical cross section with a lower flange of the bracket 8 fastened to the collector 6 and an upper flange fastened to the injector drive unit 7. More specifically, the lower flange of the bracket 8 is a rear end flange 6*c* of the collector 6, while the upper flange of the bracket 8 is fastened to a pair of mounting flanges 7*a* of the injector drive unit 7. The mounting flanges 7*a* of the injector drive unit 7 are formed in two laterally spaced locations on both the front and rear portions of the injector drive unit 7. The mounting flanges 7*a* of the injector drive unit 7 are fastened with bolts to the aforementioned two bosses 6*b* and to the upper flange of the bracket 8.

This arrangement allows the injector drive unit 7 to be mounted further rearwardly in the engine compartment where there is more vertical space above engine 1 due to the slope of the hood cover 11. Moreover, by selecting the vertical heights of the front mounting bosses 6*b* and the rear mounting bracket 8, the gap or air space between the injector drive unit 7 and the collector 6 can be set as needed and/or desired. In other words, the gap or air space between the injector drive unit 7 and the collector 6 can be set as needed and/or desired by merely changing the vertical dimension of the front mounting bosses 6*b* and the rear mounting bracket 8. By providing the gap or air space between the injector drive unit 7 and the collector 6, the efficiency of the cooling of the injector drive unit 7 is improved.

As seen in FIG. 2, the collector 6 is mounted on an upper end portion of the engine 1 between the pair of laterally spaced cylinder heads 3. This arrangement allows the injector drive unit 7 to be mounted on the collector 6 without substantially increasing the overall height requirements for the vehicle engine compartment.

The injector drive unit 7 has a plurality of cooling fins 7*b* mounted on the bottom wall or surface of the injector drive unit 7. The cooling fins 7*b* are preferably made of aluminum or the like. More preferably, the cooling fins 7*b* are integrally formed with the bottom wall of the injector drive unit 7. Also, the aforementioned mounting flanges 7*a* are preferably formed integrally with the injector drive unit 7 and the cooling fins 7*b*. Thus, with this arrangement, the heat of the cooling fins 7*b* is conducted efficiently through the integrally formed mounting flanges 7*a* to the air induction passage of the collector 6. This arrangement enables the cooling efficiency to be increased even further. The cooling fins 7*b* are arranged so as to extend substantially parallel in the longitudinal direction L, i.e., aligned with the flow of the cooling air as the vehicle moves in a forward direction, so that the cooling air contacts the injector drive unit 7 efficiently and good cooling is obtained. By arranging the cooling fins 7*b* of the injector drive unit 7 so that they are located in the air gap between the injector drive unit 7 and the collector 6, good cooling can be secured without the need for a special space and without restricting the installation space of an engine cover 10 or the like.

With the injector drive unit 7 is fastened to the upper wall of the collector 6 between the uppermost part of an engine 1 and the engine cover 10 or hood cover 11, the cooling air flowing through the engine compartment can flow efficiently over the cooling fins 7*b* of the injector drive unit 7 so that good cooling can be accomplished without providing a special air guide device or baffles.

A harness 9 connects the injector drive unit 7 to each of fuel injection valves 4. The harness 9 extends rearward from a lateral side of the injector drive unit 7 and then passes through the space under the collector 6 from the rear side of the collector 6 where the harness 9 is connected to each of the fuel injection valves 4. Preferably, the injector drive unit 7 is fastened to the end of the collector 6 that is located at one longitudinal end of the engine cylinder row of the engine 1 as seen in FIG. 3. With this arrangement, the harness 9 can be made as short as possible, because the injector drive unit 7 is disposed on the collector 6 at one longitudinal end of the engine cylinder row of the engine 1.

The engine cover 10 is arranged above the engine 1 for insulating noise. Thus, the engine cover 10 overlies the injector drive unit 7 that is mounted to the upper wall of the collector 6.

When the mounting structure of the injector drive unit 7 is as described above, good cooling performance is obtained because the injector drive unit 7 is mounted to the collector 6, which is a low-temperature air induction system component. More specifically, the cooling air flowing between the engine cover 10 and the collector 6 causes the heat generated by the power transistor, etc., of the injector drive unit 7 to be radiated mainly from the cooling fins 7*b*, which are provided so as to be aligned with the flow of the cooling air. Since the cooling fins 7*b* are mounted so as to face low-temperature the collector 6, the cooling air is kept at a low temperature and the heat is cooled efficiently.

Also, since the mounting flange 7*a* is formed integrally with the cooling fins 7*b*, the amount of heat dissipated by heat transfer from the mounting flange 7*a* to the wall of the collector 6 through bosses 6*b* is large and the cooling efficiency can be improved. It is also acceptable to use an arrangement in which the bottom end surfaces of the cooling fins 7*b* are in contact with the upper wall of the collector 6 so that heat is dissipated by heat transfer from the contacting surfaces.

Since the gap existing between the injector drive unit 7 and the upper wall of the collector 6 below the mounting surface with bosses 6*b* can be used as a space for arranging the cooling fins 7*b*, the cooling fins 7*b* can be prevented from restricting the mounting space of the engine cover 10 and causing the height of the hood 11 to be higher.

Noise insulation material is often attached to the under surface of the engine cover 10 in order to increase the noise insulating effect. Since the cooling fins 7*b*, which become hot, are disposed on the side facing the collector 6 and not the side facing the engine cover 10, thermal degradation of the noise insulation material and the engine cover 10 itself can be prevented, even if the noise insulation material is a material with low thermal resistance or the engine cover 10 itself is made of a resin material with a low thermal resistance.

Since the injector drive unit 7 is mounted to the rear end part of the collector 6, the length of the harness 9 can be shortened, making installation easy. Since the typical hood shape of a sedan is such that the hood 11 becomes higher toward the rear, the gap between the engine cover 10, which is arranged so as to follow the shape of the hood 11, and the upper wall of the collector 6 is larger at the rear part of the engine cover 10, making it easier to secure space for disposing the injector drive unit 7. However, if there is room to spare, the injector drive unit 7 can certainly be disposed at the front end part and the harness 9 can be shortened in such a case as well.

Second Embodiment

Figure 4:
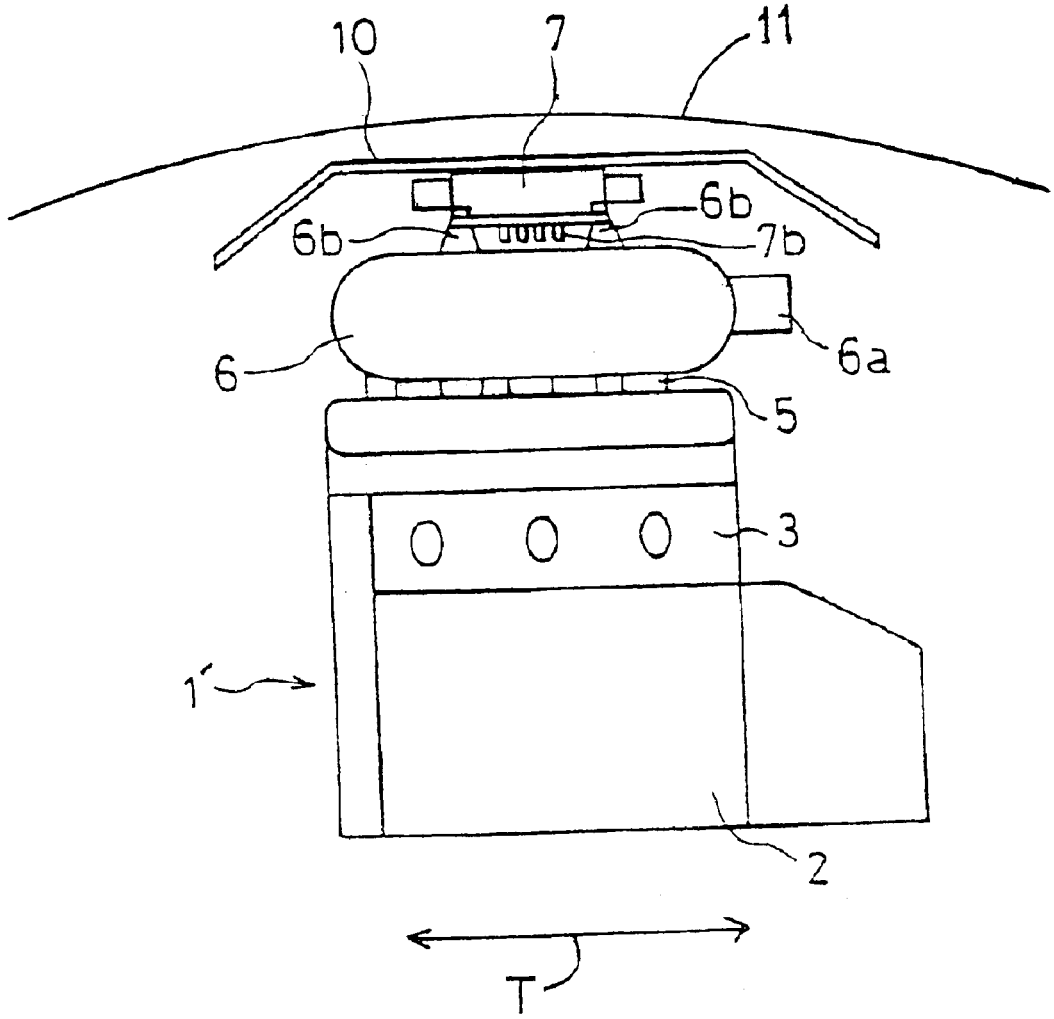
FIG. 4 is a diagrammatic front elevational view of a transversely mounted V-type engine with the injector drive unit mounted thereon in accordance with a second embodiment of the present invention.

Referring now to FIG. 4, a mounting structure in accordance with a second embodiment will now be explained. In view of the similarity between the first and second embodiments, the parts of the second embodiment that are identical to or substantially the same as the parts of the first embodiment will be given the same reference numerals as the parts of the first embodiment. In other words, parts having the same function as in the first embodiment are indicated using the same reference numerals (the same holds for subsequent embodiments). Moreover, the descriptions of the parts of the second embodiment that have the same function as the parts of the first embodiment have been omitted for the sake of brevity.

This second embodiment is an application of the invention to a V-type engine disposed transversely (cylinders are lined up in the transverse direction T of the vehicle) inside an engine compartment at the front of a vehicle. In this embodiment, the injector drive unit 7 is fastened to the upper wall of the collector 6, which is installed on the uppermost part of the engine 1', such that each of the cooling fins 7*b* is aligned with the flow direction of the cooling air and parallel in the longitudinal direction of the vehicle. Thus, the injector drive unit 7 is mounted to the rear end part of the collector 6 in the same manner as the first embodiment. Accordingly, similar effects to those of the first embodiment are obtained because only the orientation of the engine. Additionally, the mounting structure of the present invention can obtain similar effects when applied to other electrical units, other than the aforementioned injector drive unit 7, which have large amount of emitted heat.

Third Embodiment

Figure 5:
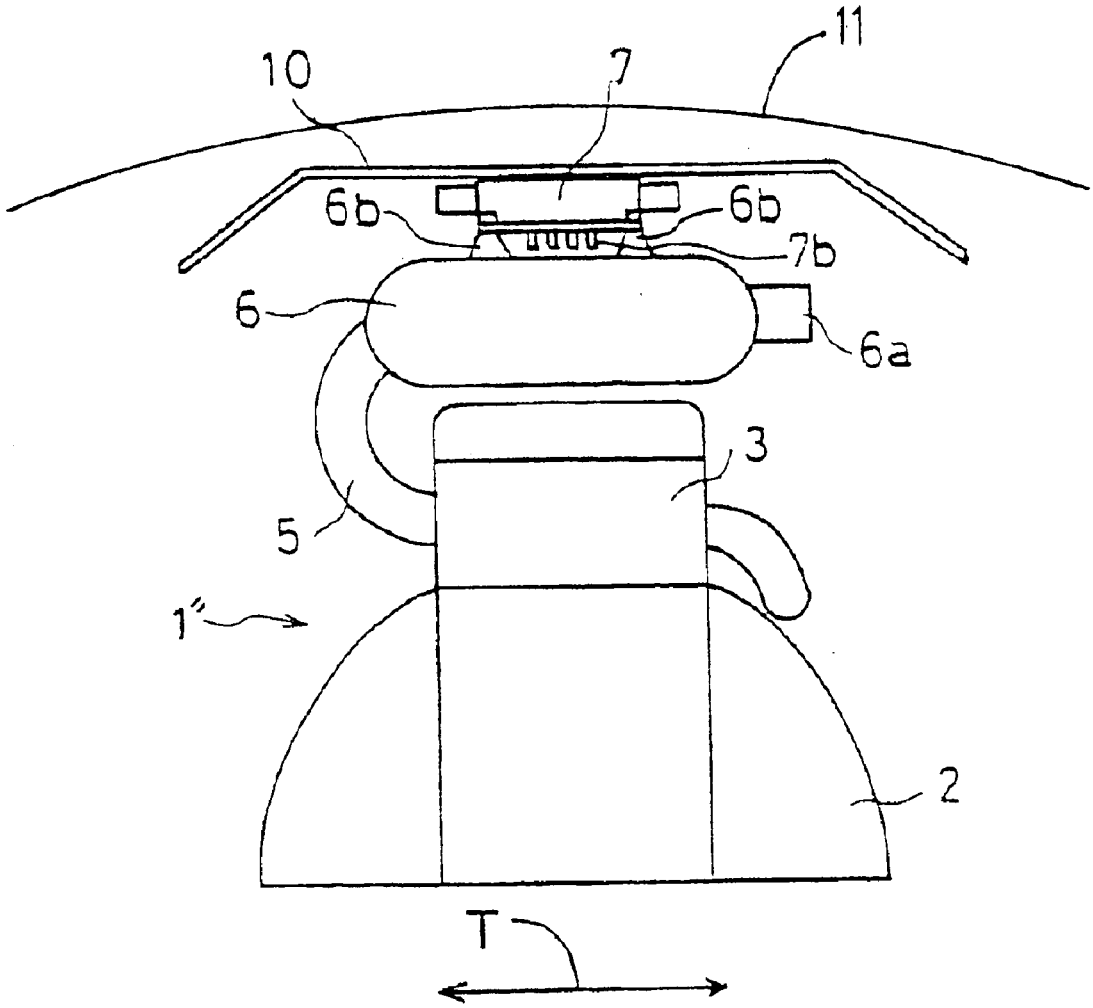
FIG. 5 is a diagrammatic front elevational view of a longitudinally mounted inline type engine with the injector drive unit mounted thereon in accordance with a third embodiment of the present invention.

Referring now to FIG. 5, a mounting structure in accordance with a third embodiment will now be explained. In view of the similarity between the first and third embodiments, the parts of the third embodiment that are identical to or substantially the same as the parts of the first embodiment will be given the same reference numerals as the parts of the first embodiment. In other words, parts having the same function as in the first embodiment are indicated using the same reference numerals. Moreover, the descriptions of the parts of the third embodiment that have the same function as the parts of the first embodiment may be omitted for the sake of brevity.

FIG. 5 shows a third embodiment of the present invention, in which the invention is applied to an inline engine 1" disposed longitudinally inside an engine compartment at the front of a vehicle. In other words, the inline engine 1" has it engine cylinders aligned in a row that is parallel to the longitudinal direction of the vehicle. Basically, the collector 6 and the injector drive unit 7 are coupled together using the same mounting structure of the first embodiment of the present invention. The mounting structure is configured and arranged to secure the injector drive unit 7 on an upwardly facing surface of the collector 6 to form an air space between the injector drive unit 7 and the collector 6. Thus, in the same manner as the first embodiment, the injector drive unit 7 is mounted to the rear end part of the collector 6 with the cooling fins 7*b* aligned with the flow direction of the cooling air and parallel in the longitudinal direction of the vehicle. With this embodiment, similar effects to those of the first embodiment are obtained with regards to the mounting structure of the injector drive unit 7. Additionally, the mounting structure of the present invention can obtain similar effects when applied to other electrical units, other than the aforementioned injector drive unit 7, which have large amount of emitted heat.

Fourth Embodiment

Figure 6:
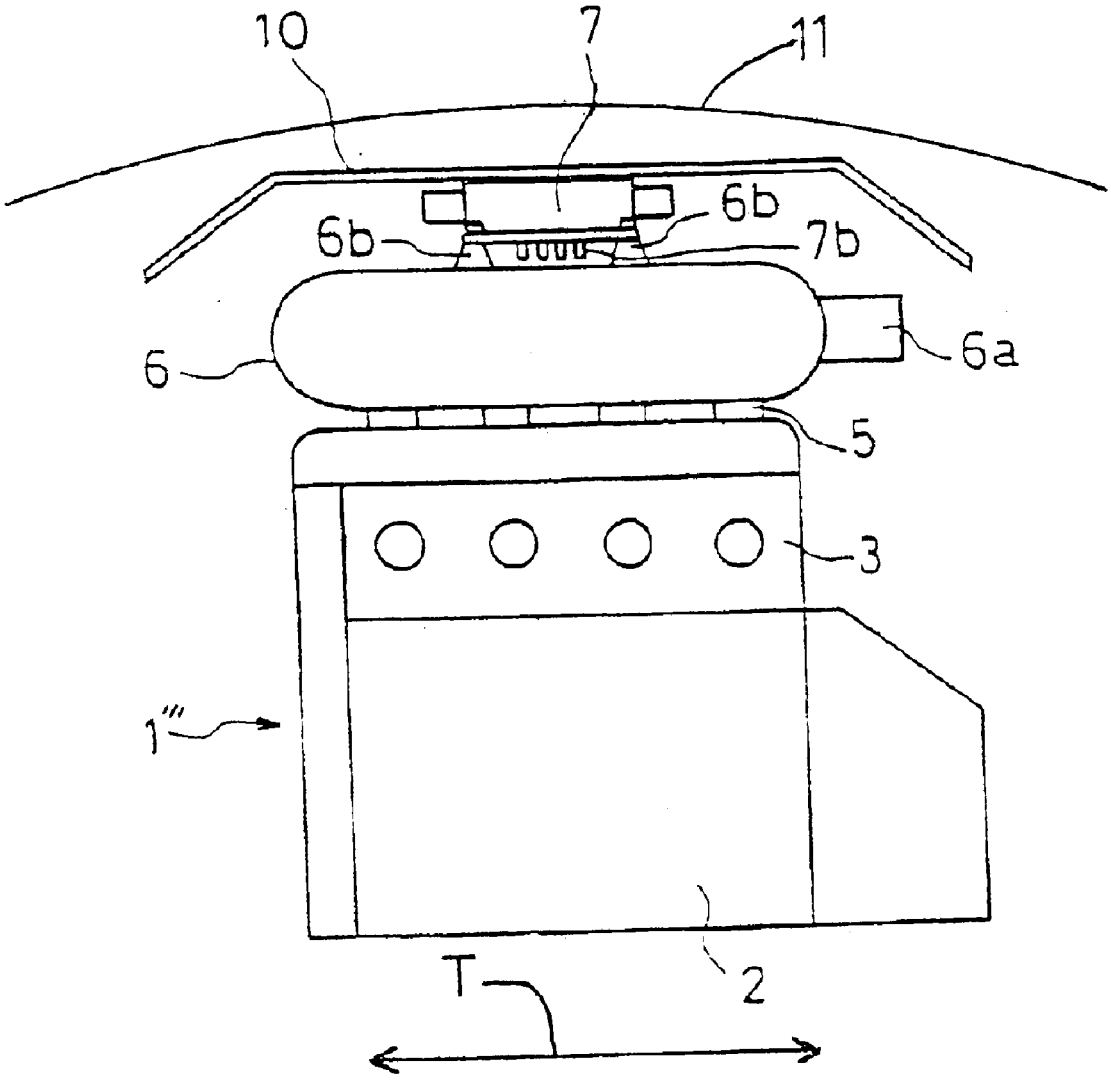
FIG. 6 is a diagrammatic front elevational view of a transversely mounted inline type engine with the injector drive unit mounted thereon in accordance with a fourth embodiment of the present invention.

Referring now to FIG. 6, a mounting structure in accordance with a fourth embodiment will now be explained. In view of the similarity between the first and fourth embodiments, the parts of the fourth embodiment that are identical to or substantially the same as the parts of the first embodiment will be given the same reference numerals as the parts of the first embodiment. In other words, parts having the same function as in the first embodiment are indicated using the same reference numerals. Moreover, the descriptions of the parts of the fourth embodiment that have the same function as the parts of the first embodiment have been omitted for the sake of brevity.

In this fourth embodiment of the present invention, the present invention is applied to an inline engine 1'" disposed transversely inside an engine compartment at the front of a vehicle. In other words, the inline engine 1'" has it engine cylinders aligned in a row that is parallel to the transverse direction T of the vehicle. Similar to the preceding embodiments, the collector 6 and the injector drive unit 7 are coupled together using the same mounting structure of the first embodiment of the present invention. Thus, the mounting structure is configured and arranged to secure the injector drive unit 7 on an upwardly facing surface of the collector 6 to form an air space between the injector drive unit 7 and the collector 6. Also, in the same manner as the first embodiment, the injector drive unit 7 is mounted to the rear end part of the collector 6 with the cooling fins 7*b* aligned with the flow direction of the cooling air and parallel in the longitudinal direction of the vehicle. With this embodiment, similar effects to those of the first embodiment are obtained with regards to the mounting structure of the injector drive unit 7. Additionally, the mounting structure of the present invention can obtain similar effects when applied to other electrical units, other than the aforementioned injector drive unit 7, which have large amount of emitted heat.

The term "configured" as used herein to describe a component, section or part of a device includes hardware and/or software that is constructed and/or programmed to carry out the desired function. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2000-397540. The entire disclosure of Japanese Patent Application No. 2000-397540 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A vehicle structure comprising:

an electrical unit of a vehicle;

an air induction component of an engine configured to be located inside an engine compartment of the vehicle; and a mounting structure configured and arranged to mount the electrical unit to the air induction component such that an air space is formed between the electrical unit and the air induction component, the electrical unit comprising a plurality of cooling fins mounted to a wall surface of the electrical unit that faces the air induction component.

2. The vehicle structure as recited in claim 1, wherein the electrical unit is attached to a rear portion of the air induction component to be located in a rearward end of the engine compartment.

3. The vehicle structure as recited in claim 2, wherein the air induction component configured to be mounted on an upper end portion of the engine, the engine being configured to be longitudinal arranged in the engine compartment relative to a longitudinal direction of the vehicle.

4. The vehicle structure as recited in claim 3, wherein the engine is a V-type engine with the air induction component being located in between a pair of laterally spaced cylinder heads.

5. A vehicle structure comprising:

an electrical unit of a vehicle;

an air induction component of an engine configured to be located inside an engine compartment of the vehicle;

a mounting structure configured and arranged to mount the electrical unit to the air induction component; and the electrical unit comprising a plurality of cooling fins mounted to a wall surface of the electrical unit that faces the air induction component, the mounting structure retaining the electrical unit above the air induction component to form an air space between the cooling fins and the air induction component.

6. The vehicle structure as recited in claim 5, wherein the mounting structure comprises a mounting boss having a predetermined height located between the electrical unit and the air induction component to form the air space with a corresponding predetermined height.

7. A vehicle structure comprising:

an electrical unit of a vehicle;

an air induction component of an engine configured to be located inside an engine compartment of the vehicle; and a mounting structure configured and arranged to mount the electrical unit to the air induction component;

the electrical unit comprising a plurality of cooling fins mounted to a wall surface of the electrical unit that faces the air induction component, the mounting structure comprising a front mounting boss fixedly coupled between a front portion of the electrical unit and a top surface of the air induction component, and a rear mounting bracket fixedly coupled between a rear portion of the electrical unit and a rear flange located on a side surface of the air induction component.

8. The vehicle structure as recited in claim 1, wherein each of the cooling fins is configured and arranged to be parallel a flow of cooling air inside the engine compartment.

9. The vehicle structure as recited in claim 1, wherein the cooling fins are formed as an integral part of the electrical unit.

10. The vehicle structure as recited in claim 1, wherein the air induction component is an air intake collector.

11. The vehicle structure as recited in claim 10, wherein the air intake collector is disposed on an uppermost part of an engine and the electrical unit is fastened to an upper wall of the air intake collector so that the electrical unit is disposed between the air intake collector and either one of an engine cover and a hood cover.

12. The vehicle structure as recited in claim 10, wherein the electrical unit is fastened to the air induction component at one end of a row of engine cylinders.

13. The vehicle structure as recited in claim 1, wherein the electrical unit is a drive unit that drives an electronic component.

14. The vehicle structure as recited in claim 13, wherein the electronic component is a fuel injection valve.

15. A method of installing a vehicle structure, comprising:

mounting an air induction component on an engine located inside an engine compartment of a vehicle;

mounting an electrical unit to the air induction component such that an air space is formed between the electrical unit and the air induction component to cool the electrical unit; and providing a plurality of cooling fins on a wall surface of the electrical unit that faces the air induction component.

16. The method as recited in claim 15, comprising attaching the electrical unit to a rear portion of the air induction component so as to be located in a rearward end of the engine compartment.

17. The method as recited in claim 15, further comprising fastening the electrical unit an upper wall of the air induction component, which is disposed on an uppermost part of an engine so that the electrical unit is disposed between the air intake collector and an engine cover or a hood cover.

18. A vehicle structure comprising:

an electrical unit of a vehicle;

an air induction component of an engine configured to be located inside an engine compartment of the vehicle;

a mounting structure configured and arranged to mount the electrical unit to the air induction component; and a plurality of cooling fins disposed between the electrical unit and an outer surface of the air induction component.

19. The vehicle structure as recited in claim 18, wherein the mounting structure retains the electrical unit above the air induction component to form an air space between the cooling fins and the air induction component.

20. The vehicle structure as recited in claim 18, wherein each of the cooling fins is configured and arranged to be parallel a flow of cooling air inside the engine compartment.

21. The vehicle structure as recited in claim 18, wherein the cooling fins are formed as an integral part of the electrical unit.

* * * * *